US007640919B1

(12) United States Patent
Smith

(10) Patent No.: US 7,640,919 B1
(45) Date of Patent: Jan. 5, 2010

(54) FUEL SYSTEM FOR PROTECTING A FUEL FILTER

(75) Inventor: Paul John Smith, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 12/010,989

(22) Filed: Jan. 31, 2008

(51) Int. Cl.
*F02M 37/00* (2006.01)
*F02M 37/04* (2006.01)

(52) U.S. Cl. ..... 123/511; 123/469

(58) Field of Classification Search ..... 123/457, 123/461, 468, 469, 456, 198 D, 446, 511; 210/90, 130, 416.4
See application file for complete search history.

(56) References Cited

U.S. PATENT DOCUMENTS

| | | | | |
|---|---|---|---|---|
| 5,642,718 | A | 7/1997 | Nakai et al. | |
| 5,723,780 | A | 3/1998 | Miwa et al. | |
| 5,794,598 | A * | 8/1998 | Janik et al. | 123/514 |
| 5,795,995 | A | 8/1998 | Shimaoka et al. | |
| 6,032,639 | A | 3/2000 | Goto et al. | |
| 6,189,509 | B1 | 2/2001 | Froment | |
| RE37,807 | E | 7/2002 | Shinogle et al. | |
| 6,520,162 | B1 | 2/2003 | Schueler | |
| 6,712,045 | B1 | 3/2004 | McCarthy, Jr. | |
| 6,752,130 | B2 * | 6/2004 | Schueler et al. | 123/514 |
| 6,802,209 | B2 | 10/2004 | Joos et al. | |
| 7,044,110 | B2 | 5/2006 | Geyer | |
| 7,150,270 | B2 | 12/2006 | Hoffmann et al. | |
| 7,163,003 | B2 | 1/2007 | Bradford | |
| 2003/0111052 | A1 * | 6/2003 | Schueler et al. | 123/446 |
| 2004/0055575 | A1 | 3/2004 | McCarthy, Jr. et al. | |
| 2004/0055576 | A1 | 3/2004 | McCarthy, Jr. | |
| 2005/0150480 | A1 * | 7/2005 | Hoffmann et al. | 123/459 |
| 2007/0039865 | A1 * | 2/2007 | Jiang et al. | 210/259 |
| 2007/0095329 | A1 | 5/2007 | Lang et al. | |

FOREIGN PATENT DOCUMENTS

| | | |
|---|---|---|
| DE | 19823143 | 11/1999 |
| GB | 2325023 | 11/1998 |
| WO | 0236997 | 5/2002 |
| WO | 2005017361 | 2/2005 |

OTHER PUBLICATIONS

U.S. Appl. No. 12/071,687, filed Feb. 25, 2008 (13 pages total, including 1 drawing sheet).

* cited by examiner

*Primary Examiner*—Mahmoud Gimie
(74) *Attorney, Agent, or Firm*—Finnegan, Henderson, Farabow, Garrett & Dunner

(57) ABSTRACT

A fuel system is disclosed. The fuel system has a first pump supplying fuel at a first pressure. The fuel system also has a fuel filter fluidly connected downstream of the first pump. The fuel system further has a second pump receiving fuel at a second pressure and fluidly connected downstream of the fuel filter. The fuel system additionally has a first passage fluidly connecting an outlet of the first pump to an inlet of the first pump. The fuel system also has a valve located within the first passage and configured to selectively allow fuel flow through the first passage. The fuel system further has a second passage fluidly connecting an inlet of the second pump to the valve, wherein the second pressure acts on the valve to affect fuel at the first pressure to flow to the inlet of the first pump via the first passage when the second pressure is greater than a predetermined pressure.

16 Claims, 2 Drawing Sheets

FUEL SYSTEM FOR PROTECTING A FUEL FILTER

TECHNICAL FIELD

The present disclosure is directed to a fuel system and, more particularly, to a fuel system for protecting a fuel filter.

BACKGROUND

Diesel engines typically rely on compression ignition, where fuel is injected into a combustion chamber after air has been compressed, resulting in substantially immediate combustion without requiring a sparkplug. Compression ignition diesel engines typically include a common rail fuel injection system, which directs pressurized fuel to individual fuel injectors for injection into the combustion chamber. Prior to entering the common rail, fuel is typically pumped through a primary filter and a secondary filter by a feed pump located between the filters. A high-pressure pump is typically located downstream of the secondary filter.

In typical systems, a regulator valve positioned between the secondary filter and the high-pressure pump returns excess fuel (i.e., fuel in excess of a capacity of the high-pressure pump) to the inlet of the feed pump. Therefore, more fuel than necessary passes through the secondary filter, reducing the useful life of the secondary filter or otherwise requiring the secondary filter to be designed larger than necessary to handle the excess flow without reducing the useful life.

One attempt at preventing unnecessary flow across a filter of a fuel injection system is described in U.S. Pat. No. 6,520,162 (the '162 patent) issued to Schueler. The '162 patent discloses a common rail system provided with a pre-feed pump for delivering a fuel flow from a fuel tank to a high-pressure pump. The '162 patent also discloses a fuel filter disposed downstream of the pre-feed pump and a safety valve device that is dependent on a fuel filter pressure difference for shutting off flow through the filter, and a bypass to circumvent the safety valve device.

Although the fuel injection system of the '162 patent may provide a method for protecting a fuel pump from damage due to abnormal conditions, it fails to provide a method for controlling fuel flow during normal conditions. Specifically, the '162 patent fails to prevent unnecessary flow across a fuel filter during normal operating conditions to extend the useful life of the filter or to allow for a smaller filter design area.

The present disclosure is directed to overcoming one or more of the problems set forth above.

SUMMARY OF THE DISCLOSURE

In accordance with one aspect, the present disclosure is directed toward a fuel system. The fuel system includes a first pump supplying fuel at a first pressure. The fuel system also includes a fuel filter fluidly connected downstream of the first pump. The fuel system further includes a second pump receiving fuel at a second pressure and fluidly connected downstream of the fuel filter. The fuel system additionally includes a first passage fluidly connecting an outlet of the first pump to an inlet of the first pump. The fuel system also includes a valve located within the first passage and configured to selectively allow fuel flow through the first passage. The fuel system further includes a second passage fluidly connecting an inlet of the second pump to the valve, wherein the second pressure acts on the valve to affect fuel at the first pressure to flow to the inlet of the first pump via the first passage when the second pressure is greater than a predetermined pressure.

According to another aspect, the present disclosure is directed toward a method for directing fuel flow. The method includes directing fuel from a first location at a first pressure to a second location at a second pressure. The method also includes filtering the fuel between the first and second locations. The method further includes pumping the fuel at a location downstream from the second location. The method additionally includes diverting an amount of fuel at the first pressure from the first location to a location upstream of the first location, when the second pressure exceeds a desired pressure.

DETAILED DESCRIPTION

Figure 1:
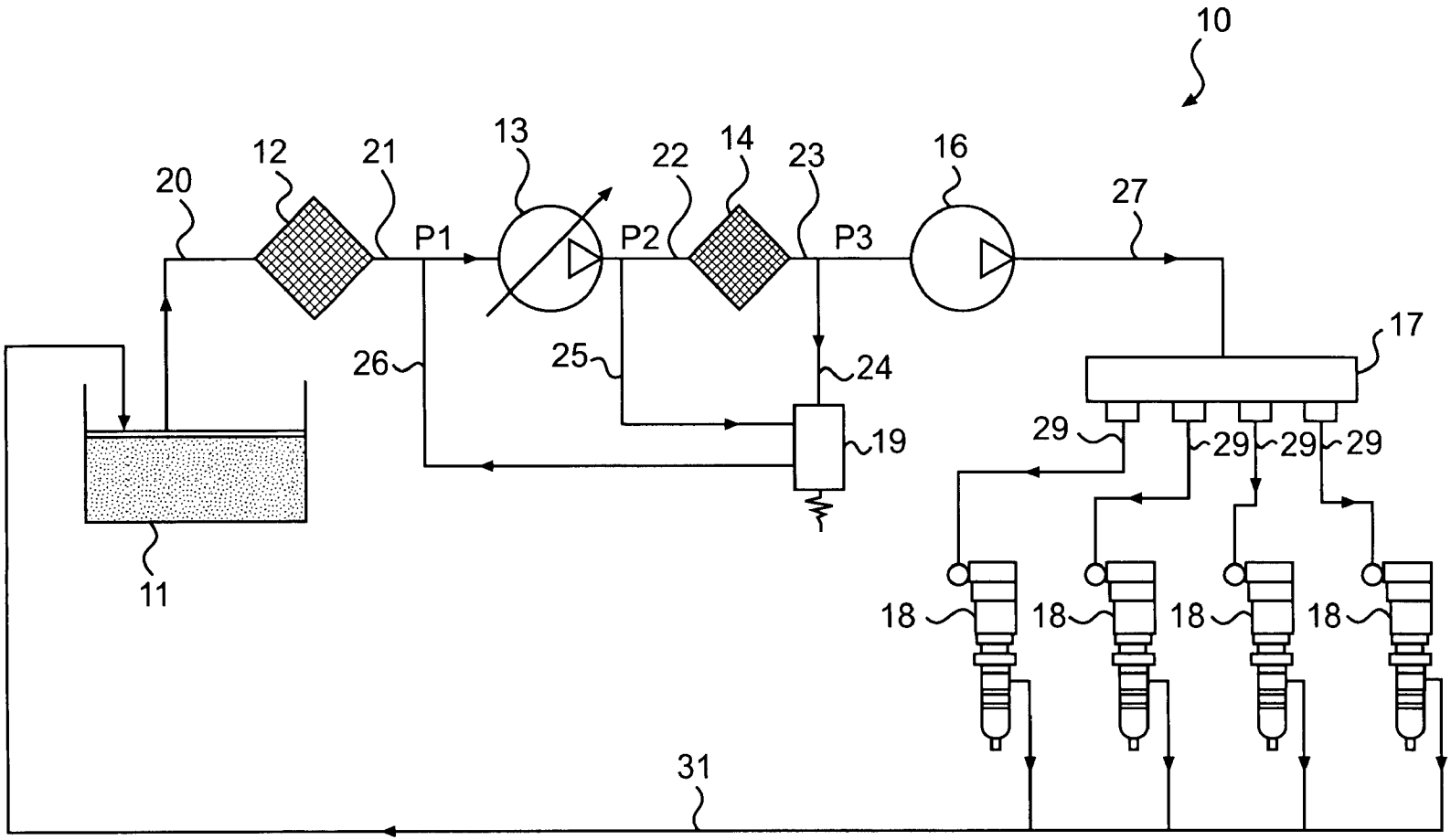
FIG. 1 is a schematic illustration of an exemplary disclosed fuel injection system.

FIG. 1 illustrates an exemplary fuel system 10. Fuel system 10 may be a common rail fuel injection system and may include a fuel reservoir 11, fluidly connected via a passage 20 to a filter 12. A pump 13 may be fluidly connected downstream of filter 12 via a passage 21, and may be fluidly connected upstream from a filter 14 via a passage 22. Fuel system 10 may additionally include a pump 16 fluidly connected downstream from filter 14 via a passage 23. A common rail 17 may be fluidly connected downstream from pump 16 via a passage 27 and may be fluidly connected upstream from a plurality of injectors 18 via a plurality of passages 29. Injectors 18 may inject fuel into an engine (not shown) and may be fluidly connected to reservoir 11 via a leak return passage 31.

Filter 12 and filter 14 may be any suitable type of fuel filter known in the art such as, for example, a stainless steel or a plastic fuel filter. Filter 12 and filter 14 may serve to screen out rust, dirt, or other particles from the fuel. These particles may enter fuel system 10, for example, when rust or paint chips are knocked into a fuel inlet during fueling or from rust that develops from moisture from water in reservoir 11. Filter 12 may be a primary filter configured to remove larger particles than filter 14, which may be a secondary filter configured to remove relatively small particles. This arrangement may allow the fuel to be filtered in a two-step process in which larger particles may be filtered via filter 12 and smaller particles may be filtered via filter 14. By removing foreign material from the fuel, filter 12 and filter 14 may serve to prevent abrasive wear by the particles on fuel injectors 18. Filter 12 and filter 14 may also allow the engine to operate more efficiently, as uncontaminated fuel may burn more efficiently than contaminated fuel.

Pump 13 may be a swash plate pump, having a rotating cylinder (not shown) containing pistons (not shown). A spring (not shown) may force the pistons against a swash plate (not shown), the swash plate being oriented at an angle to the pistons. As the swash plate rotates relative to the pistons, the pistons receive fluid during the first half of each revolution and force fluid out at an elevated pressure during the second half. The swash plate angle may be varied, with the amount of fuel transferred increasing as the angle of the swash plate increases. It is contemplated that pump 13 may also be a gear pump or a vane pump. Pump 13 may serve as a feed pump to direct fuel from reservoir 11, through filter 12 and filter 14, and into pump 16.

Pump 16 may be any type of high-pressure pump known in the art that is suitable for common rail fuel injection. Pump 16 may include a housing (not shown) defining a plurality of barrels (not shown). Plungers (not shown) may be slidably disposed within each barrel, defining pumping chambers. The plungers may be driven by any suitable actuator known in the art such as, for example, a cam, a solenoid actuator, a piezo actuator, a hydraulic actuator, or a motor. Pump 16 may serve to maintain fuel stored within a reservoir (not shown) of common rail 17 at a relatively high-pressure. Pump 13 and pump 16 may be either engine-driven or independently driven.

Common rail 17 may be an intake manifold configured to distribute the flow of pressurized fluid from pump 16. Common rail 17 may be configured to distribute fuel to injectors 18 via passages 29. Common rail 17 and injectors 18 may be associated with a controller (not shown) that may control an actuation timing, pressure, and duration of fuel injected by fuel injectors 18. By injecting pressurized fuel at optimal times during engine operation, for example at the end of a compression stroke of the engine, common rail 17 and injectors 18 may provide for better fuel atomization and thereby better engine efficiency.

Figure 2:
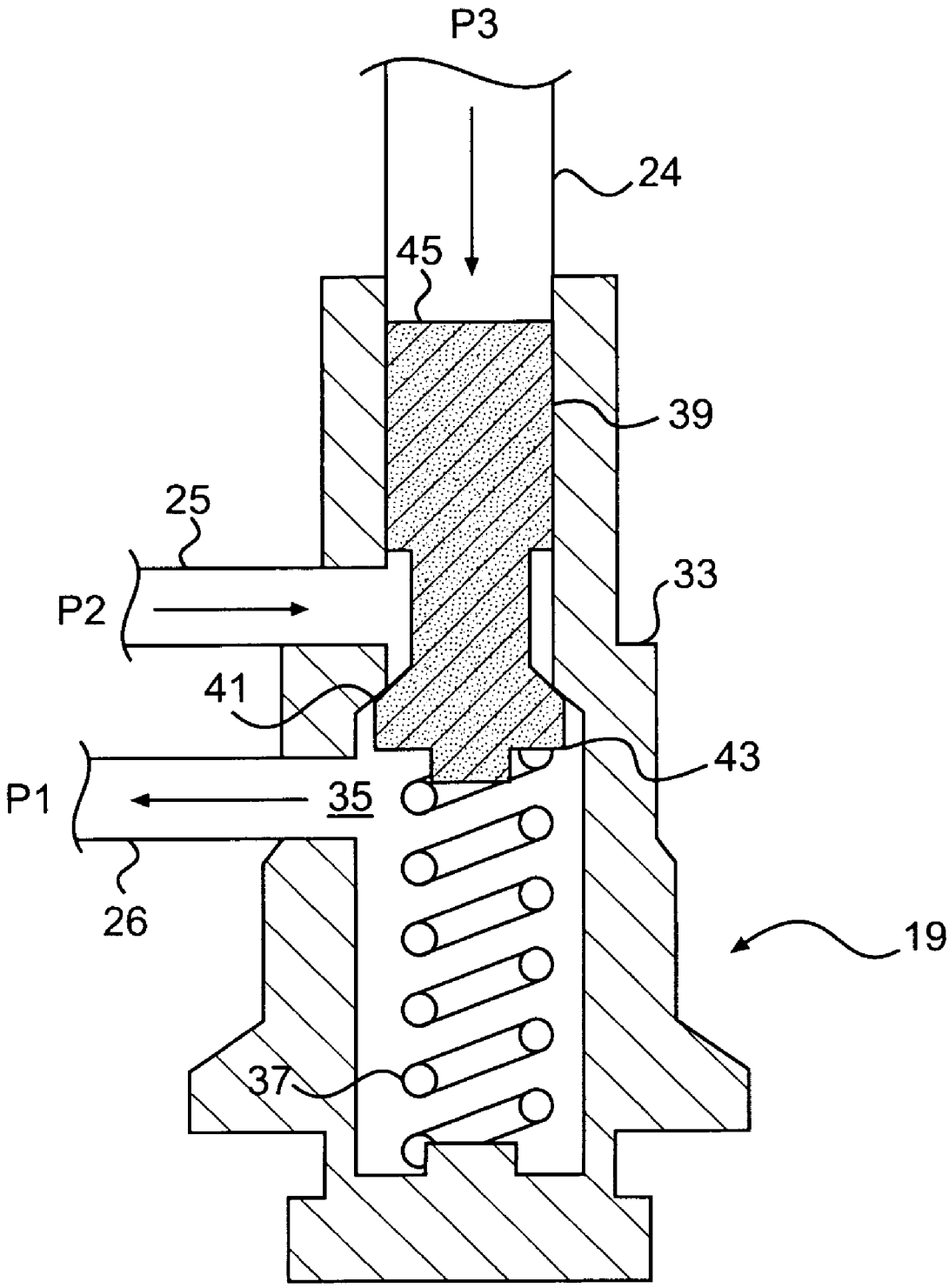
FIG. 2 is a cross-section of an exemplary disclosed regulator valve of the fuel injection system.

Fuel system 10 may also include a regulator valve 19 for controlling the amount of flow passing through filter 14. Regulator valve 19 may be configured to use hydraulic feedback to adjust fuel flow. As shown in FIG. 2, regulator valve 19 may include a housing 33, which may provide a bearing surface for a spring 37 located within a spring cavity 35 of housing 33. Regulator valve 19 may further include a plunger 39, which may be housed within housing 33. A first end 43 of plunger 39 may be connected to spring 37, so that displacement of plunger 39 may cause an expansion or contraction of spring 37. Spring 37 may be pre-loaded so that it biases plunger 39 against a seat 41 of housing 33. As shown in FIG. 2, a passage 25 may be fluidly connected to housing 33 at a location on a first side of seat 41, and a passage 26 may be fluidly connected to spring cavity 35 of housing 33 at a location on a second side (opposite to the first side) of seat 41. A passage 24 may be fluidly connected to housing 33, where passage 24 may be adjacent to a second end 45 of plunger 39.

The pressure of pressurized fluid in passage 24 may act on second end 45 of plunger 39, exerting a force against plunger 39. The force exerted may exceed the pre-loading in spring 37, which may cause spring 37 to contract and allow movement of plunger 39. The pre-loading in spring 37 may be equivalent to a predetermined pressure (e.g., a desired inlet pressure) of pump 16. If the pressure at the inlet of pump 16 and passage 24 exceeds the desired pressure, plunger 39 may move away from seat 41, establishing a fluid connection between passage 25, spring cavity 35, and passage 26. Regulator valve 19 may direct excess fuel flow from an outlet of pump 13 to an inlet of pump 13, via passage 25 and passage 26, thereby diverting excess fuel from filter 14. Thus, regulator valve 19 may be configured to selectively permit fuel to flow from the outlet of pump 13 to the inlet of pump 13 as a function of the pressure at the inlet of pump 16. As the fuel flow is diverted from filter 14 and the inlet of pump 16, the pressure of pressurized fluid in passage 24 may decrease, allowing spring 37 to expand and closing regulator valve 19 to substantially block flow between passage 25 and passage 26.

INDUSTRIAL APPLICABILITY

The disclosed fuel injection system may prolong the useful life of fuel filter 14 by utilizing regulator valve 19 for maintaining a flow across filter 14 that maintains a desired pressure at the inlet of pump 16. By maintaining the desired pressure, the useful life of fuel filter 14 may be prolonged and/or a smaller filter design area may be used, resulting in cost savings.

Referring to FIG. 1, pump 13 may pump fuel from reservoir 11 to pump 16 through passages 20, 21, 22, and 23, filter 12, and filter 14. Regulator valve 19 may maintain a pressure P3 at the inlet to pump 16 at a desired inlet pressure, optimal for operation of pump 16. Pressure P3 at the inlet of pump 16 may act via passage 24 on second end 45 of plunger 39, exerting a force (i.e., pressure P3 multiplied by the area of end 45) against plunger 39. When pressure P3 exceeds the desired inlet pressure of pump 16, the force exerted may cause spring 37 to contract and allow plunger 39 to move away from seat 41. A fluid connection between passage 25, spring cavity 35, and passage 26 may be established. Fuel at a pressure P2 at the outlet of pump 13 may flow from the outlet of pump 13 to the inlet of pump 13, via passage 25 and passage 26, thereby diverting excess fuel flow from filter 14. Fuel at the inlet of pump 13 may be pressurized at a pressure P1. As the fuel flow is diverted from filter 14 and the inlet of pump 16, pressure P3 at the inlet to pump 16 may decrease until equal to the desired pressure, allowing spring 37 to expand and closing regulator valve 19.

Fuel system 10 may help to reduce costs associated with fuel filter 14. Fuel system 10 may prolong the useful life of fuel filter 14 by utilizing regulator valve 19 to maintain a flow across filter 14 that corresponds to the desired pressure at the inlet of pump 16. By preventing unnecessary flow in this manner, the useful life of filter 14 may be prolonged. By preventing unnecessary flow, the design area of filter 14 may also be reduced, which may result in cost savings.

It will be apparent to those skilled in the art that various modifications and variations can be made to the disclosed fuel system. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A fuel system, comprising:

a first pump supplying fuel at a first pressure;

a fuel filter fluidly connected downstream of the first pump;

a second pump receiving fuel at a second pressure, wherein the second pump is fluidly connected downstream of the fuel filter;

a first passage fluidly connecting an outlet of the first pump to a valve;

a second passage fluidly connecting the valve to an inlet of the first pump, the valve configured to selectively allow fuel flow from the first passage to the second passage; and a third passage fluidly connecting an inlet of the second pump to the valve, wherein the second pressure acts on the valve to affect fuel at the first pressure to flow to the inlet of the first pump via the first and second passages when the second pressure is greater than a predetermined pressure.

2. The fuel system of claim 1, wherein the valve includes a plunger connected to a pre-loaded spring.

3. The fuel system of claim 2, wherein the pre-loaded spring is pre-loaded with a force corresponding to the predetermined pressure at the inlet to the second pump.

4. The fuel system of claim 3, wherein the plunger and the spring substantially block flow when the second pressure is less than the predetermined pressure.

5. The fuel system of claim 4, wherein the valve is configured to close when the second pressure is less than the predetermined pressure.

6. The fuel system of claim 3, wherein the plunger and spring displace when the second pressure exceeds the predetermined pressure.

7. The fuel system of claim 6, wherein the valve is configured to open when the second pressure exceeds the predetermined pressure.

8. The fuel system of claim 1, wherein the fuel system is a common rail fuel injection system.

9. The fuel system of claim 1, further including a common rail located downstream from the second pump.

10. A fuel injection system, comprising:

a reservoir;

a first filter fluidly connected downstream from the reservoir;

a first pump fluidly connected downstream from the first filter and configured to supply pressurized fuel at a first pressure;

a second filter fluidly connected downstream from the first pump;

a second pump fluidly connected downstream from the second filter and configured to receive pressurized fuel at a second pressure;

a first passage fluidly connecting an outlet of the first pump to a valve;

a second passage fluidly connecting the valve to an inlet of the first pump, the valve configured to selectively allow fuel flow from the first passage to the second passage; and a third passage fluidly connecting an inlet of the second pump to the valve, wherein the second pressure acts on the valve to affect fuel at the first pressure to flow to the inlet of the first pump via the first and second passages based on the second pressure.

11. The fuel injection system of claim 10, wherein the valve includes a plunger connected to a pre-loaded spring.

12. The fuel injection system of claim 11, wherein the spring is pre-loaded with a force corresponding to a desired pressure at an inlet of the second pump.

13. The fuel injection system of claim 10, wherein the fuel injection system is a common rail fuel injection system.

14. The fuel injection system of claim 10, wherein the second pump pressurizes a common rail for fuel injection into an engine.

15. The fuel injection system of claim 10, wherein the first passage fluidly connects the outlet of the first pump to the inlet of the first pump.

16. The fuel injection system of claim 10, wherein the second pressure is a pressure upstream from the second pump.

* * * * *